US006511704B1

(12) United States Patent
Zickell

(10) Patent No.: US 6,511,704 B1
(45) Date of Patent: Jan. 28, 2003

(54) SYSTEM AND METHOD FOR DEPOSITING GRANULES IN A FRAME PATTERN

(75) Inventor: Thomas J. Zickell, Newcastle, NH (US)

(73) Assignee: Environmental Reprocessing, Inc., Brentwood, NH (US)

( * ) Notice: Subject to any disclaimer, the term of this patent is extended or adjusted under 35 U.S.C. 154(b) by 0 days.

(21) Appl. No.: 09/672,944

(22) Filed: Sep. 28, 2000

(51) Int. Cl.[7] ..... B05D 1/12
(52) U.S. Cl. ..... 427/188; 427/186
(58) Field of Search ..... 427/186, 188; 428/143, 148, 149; 52/555

(56) References Cited

U.S. PATENT DOCUMENTS

| | | | | |
|---|---|---|---|---|
| 1,250,577 A | | 12/1917 | Goldberg | |
| 1,900,598 A | * | 3/1933 | Doyen | |
| 2,000,077 A | | 5/1935 | Harshberger | 91/18 |
| 2,111,565 A | * | 3/1938 | Limerick | |
| 2,728,685 A | | 12/1955 | Muench | 117/25 |
| 3,239,367 A | | 3/1966 | Demeter | 117/68 |
| 3,534,787 A | | 10/1970 | Heck | 141/131 |
| 3,627,557 A | | 12/1971 | Chi Sato et al. | 117/37 |
| 3,639,050 A | | 2/1972 | Staller | 355/3 |
| 3,924,561 A | | 12/1975 | Ruhart et al. | 118/9 |
| 4,060,651 A | | 11/1977 | DaMart | 427/285 |
| 4,064,288 A | | 12/1977 | Shah et al. | 427/58 |
| 4,141,313 A | | 2/1979 | Hefele | 118/212 |
| 4,264,644 A | | 4/1981 | Schaetti | 427/55 |
| 4,295,445 A | | 10/1981 | Kopenhaver | 118/695 |
| 4,343,260 A | | 8/1982 | Yajima et al. | 118/204 |
| 4,529,625 A | | 7/1985 | Reidenbach et al. | 427/186 |
| 4,752,510 A | | 6/1988 | Hallworth | 427/256 |
| 5,048,453 A | | 9/1991 | Eriksson | 118/249 |
| 5,093,158 A | | 3/1992 | Li et al. | 427/278 |
| 5,101,759 A | | 4/1992 | Hefele | 118/202 |
| 5,251,989 A | | 10/1993 | Di Luco | 400/240.3 |
| 5,283,080 A | | 2/1994 | Lamb et al. | 427/8 |
| 5,415,717 A | | 5/1995 | Perneborn | 156/276 |
| 5,597,618 A | | 1/1997 | Bayer, Jr. et al. | 427/207.1 |
| 5,766,678 A | * | 6/1998 | Belt et al. | |

* cited by examiner

*Primary Examiner*—Fred J. Parker

(57) ABSTRACT

The method of depositing granules in a frame pattern includes moving an asphalt-coated web and depositing successive granule blend drops on the web. The first blend drop has a first color and forms a first blend drop pattern defining an inner region. The second blend drop has a second color and forms a second blend drop pattern sized to fit within the inner region of the first blend drop such that the first blend drop frames the second blend drop. A third blend drop having a different third color or the same as the first color is deposited such that the third blend drop adheres to an intermediate region between the first and second blend drops. The system includes a mechanism for moving the web and an asphalt coater for coating the web with asphalt. First and second media applicators are used to deposit the first and second blend drops in the respective first and second blend drop patterns. A third media applicator deposits the third blend drop as a curtain of granules over the first and second blend drop patterns.

19 Claims, 4 Drawing Sheets

SYSTEM AND METHOD FOR DEPOSITING GRANULES IN A FRAME PATTERN

FIELD OF THE INVENTION

This invention relates to a system and method for depositing a pattern of media and in particular, to a system and method for depositing granules in a frame pattern.

BACKGROUND OF THE INVENTION

A common method of manufacturing roofing materials involves depositing granules on a coated sheet of material, such as a web material that is coated with asphalt. A common roofing material is the roofing shingle which presents a well defined and pleasing pattern on a roof. Shingles are time consuming to install, however, and the seams present a potential source of water leaks. Although a continuous sheet of roofing material would be preferable, such a continuous sheet lacks the distinctive "shingle" pattern users have grown accustomed to.

Some attempts have been made at depositing granule patterns on a continuous sheet of material. The continuous sheet of material is unrolled, coated with a tacky material such as asphalt, and moved beneath a granule application device that drops granules onto the tacky coating covering the sheet. Existing granule application devices are limited in that they are not capable of depositing granules in a well defined pattern, such as a pattern formed by groups of different colored granules, referred to as "blend drops." Such patterns can be used to simulate traditional slate or wood roofs and would save considerable time in the roofing industry.

A typical granule application device uses a hopper and a roll rotating beneath the hopper to allow the granules to fall onto the moving sheet of roofing material itself. However, such devices do not adequately control the falling of the granules onto the moving sheet of roofing material and do not allow the granules to be deposited precisely in a well defined pattern. In particular, the edges of the "blend drops" can not be squared or made the same length.

Accordingly, what is needed is a system and method for precisely depositing granule "blend drops" in a pattern, for example, simulating traditional slate or wood roofs.

SUMMARY OF THE INVENTION

The present invention features a method of depositing a plurality of color groups of granules to form a predefined pattern. The method comprises moving a sheet of material having an adhesive material on a surface thereof. A first group of granules is deposited on the moving sheet of material. The first group of granules has a first color and forms a first predefined blend drop pattern defining an inner region. A second group of granules is then deposited on the moving sheet within the inner region of the first predefined pattern of the first group of granules. The second group of granules has a second color and forms, a second predefined blend drop pattern. The first predefined blend drop pattern and the second predefined blend drop pattern define an intermediate region therebetween. A third group of granules is then deposited on the moving sheet. The third group of granules adheres to the moving sheet at least in the intermediate region between the first and second group of granules, thereby forming the predefined pattern.

According to the preferred method, the first predefined blend pattern is a frame pattern, and the second predefined blend drop pattern is a solid pattern. The step of depositing the third group of granules preferably includes depositing a curtain of granules over the moving web. The third group of granules can be the same as the first color or a different third color.

The present invention also features a system for depositing granules in the predefined pattern. The system includes a mechanism for moving a web and a coater for coating the web with an asphalt composition. The system also includes first and second media applicators for depositing the respective first and second groups of granules in the respective first and second predefined blend drop patterns. The first and second media applicators preferably include a hopper containing the respective granules, a media applicator roll for receiving the granules and depositing the granules on the web in the respective predefined blend drop pattern, and a media retaining member for maintaining the granules in the respective predefined blend drop pattern on the media applicator roll. The system also includes a third media, applicator for depositing a third group of granules over the first and second groups of granules.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
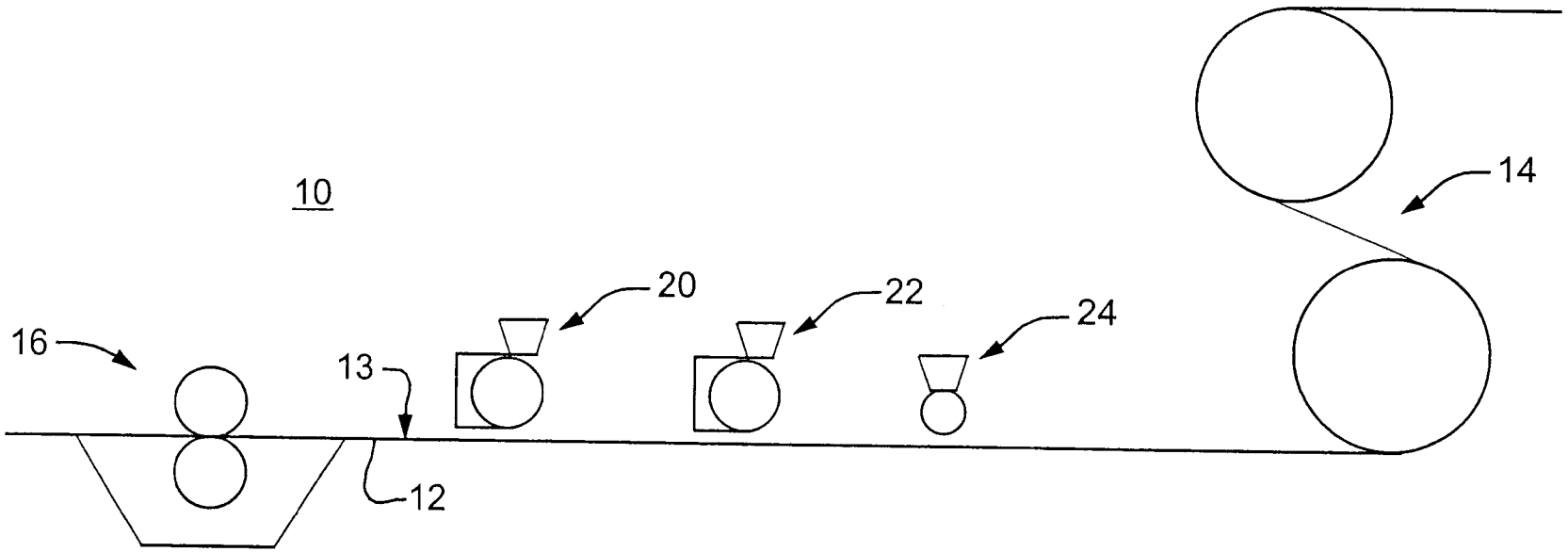
FIG. 1 is a schematic diagram of the system for depositing granules, according to the present invention.

The system 10, FIG. 1, of the present invention, deposits groups of granules (or blend drops) to form a predefined pattern on an asphalt-coated web 12. The exemplary system and method described below deposits groups of granules having different colors to form a frame pattern capable of simulating traditional slate or wood roofs. One example of the granules includes conventional roofing granules known to those of ordinary skill on the art. The concepts of the present invention can be used, however, to deposit other types of materials having different colors, textures, or other characteristics and to create other types of patterns for use in other applications.

The system 10 includes a mechanism 14 for moving the web 12, such as a fiberglass mat, and an asphalt coater 16 for coating the web 12 with an asphalt composition. Any type of web conveying mechanism 14 and asphalt coater 16 and any type of web material and asphalt composition or other adhesive material known to one of ordinary skill in the art can be used. The system 10 further includes a series of media applicators 20, 22, and 24 for separately depositing the groups of granules or blend drops in 13 different colors and/or patterns on the moving asphalt-coated web 12. The blend drops adhere to the asphalt-coated surface 13 of the web 12 to form the predefined pattern, such as a frame pattern.

Figure 2:
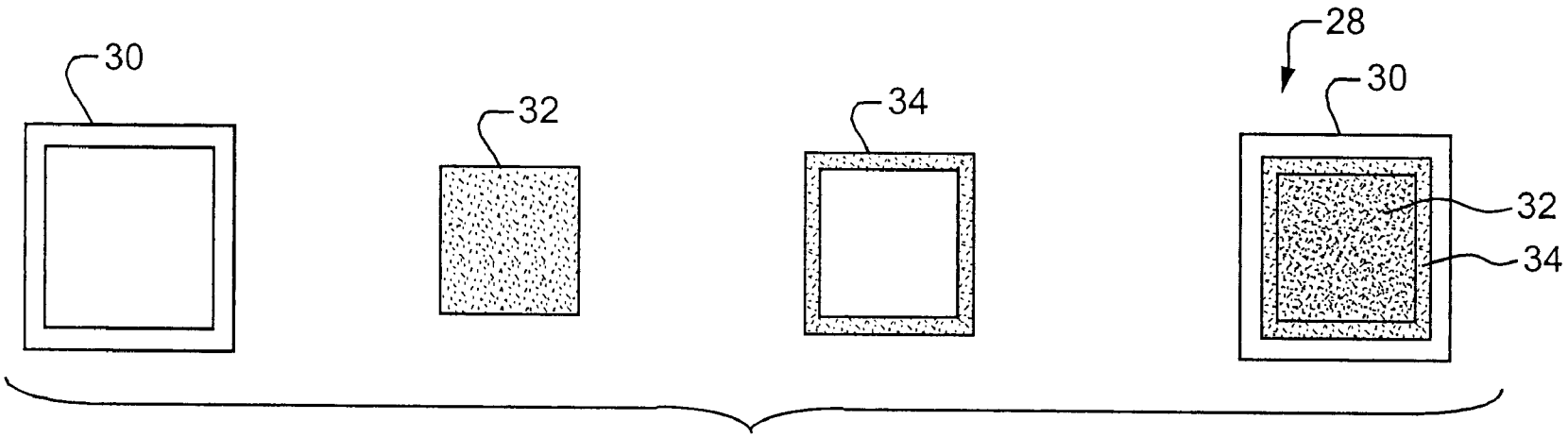
FIG. 2 is a schematic representation of the individual blend drops that form the predefined pattern, according to the present invention.

Referring to FIG. 2, the exemplary frame pattern 28 is shown together with the separate blend drops 30, 32, 34, which form the frame pattern 28 when combined. The first blend drop 30 has a first color and forms a first predefined blend drop pattern, preferably a frame. The second blend drop 32 has a second color and forms a second predefined blend drop pattern, preferably a solid shape. In the frame pattern 28, the first blend drop 30 forms a frame generally around the second blend drop 32. The third blend drop 34 fills in between the first and second blend drops 30, 32. The third blend drop can have a different third color, resulting in a three color frame pattern 28, or can be the same as the first color, resulting in a two color frame pattern (not shown).

Although the exemplary frame pattern 28 and blend drops 30, 32, 34 are square shaped, the pattern can have other shapes. The frame formed by the first blend drop 30 also does not need to be closed on all sides. Although the exemplary embodiment includes three blend drops, the concepts of the present invention can also be used to deposit more or less blend drops to create any desired pattern.

Figure 3:
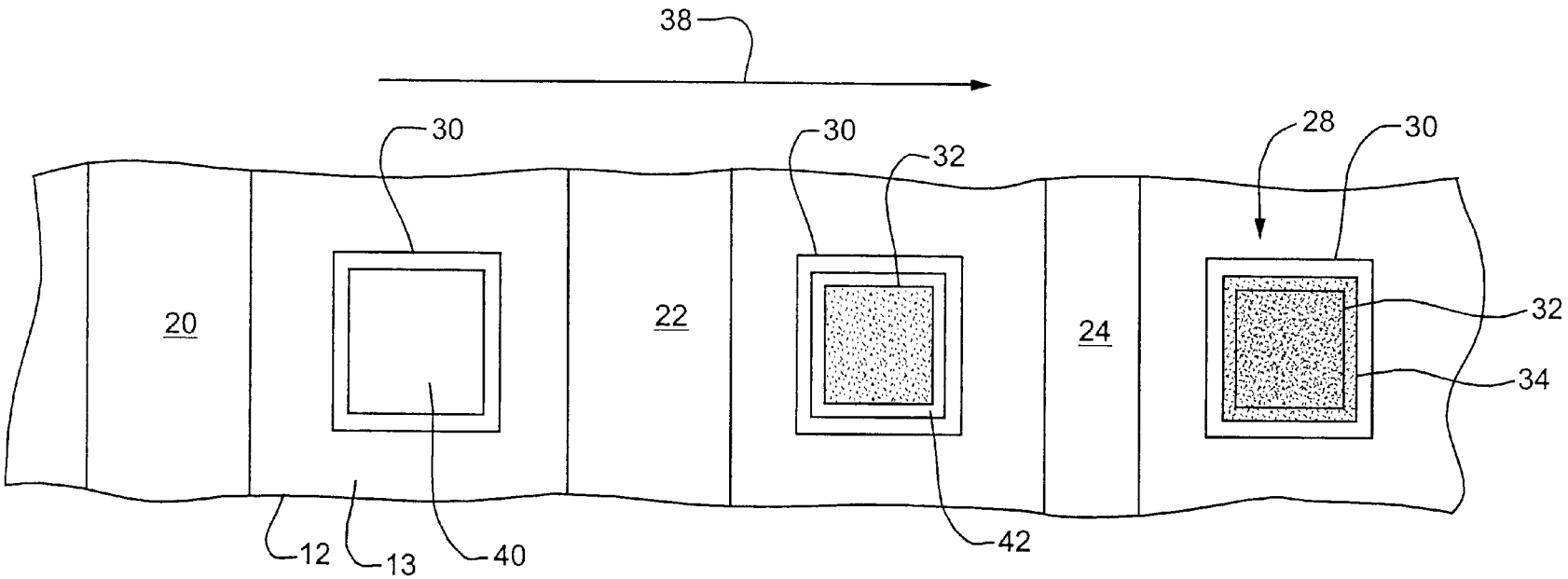
FIG. 3 is a schematic representation of the creation of the predefined pattern, according to the present invention.

Referring to FIG. 3, the creation of the frame pattern 28 is shown as each of the blend drops 30, 32, 34 are deposited successively by the respective media applicators 20, 22, 24 as the web 12 moves generally in the direction of arrow 38. The first blend drop 30 is deposited by the first media applicator 20 in the first predefined blend drop pattern (e.g., the square frame). The granules in the first blend drop 30 adhere to the asphalt coated surface 13 and define an inner region 40 that is essentially free of granules.

The second blend drop 32 is deposited by the second media applicator 22 in the second predefined blend drop pattern (e.g., the solid square) within the inner region 40 of the first blend drop 30. The second blend drop 32 is preferably sized smaller than the inner region 40 to provide the needed tolerance for error in placement on the moving web 12. The smaller second blend drop 32 adheres to the asphalt coated surface 13 within the inner region 40 such that an intermediate region 42 is defined between the first and second blend drops 30, 32.

The third blend drop 34 is deposited by the third media applicator 24 over the first and second blend drops 30, 32 such that the granules in the third blend drop 34 adhere to the intermediate region 42. The third blend drop 34 can be deposited as a curtain of granules such that the granules in the third blend drop 34 adhere to all regions on the web 12 with remaining exposed asphalt. By applying the blend drop 30 having the frame pattern first, the granules in the subsequent blend drops 32, 34 will not adhere to the frame and the frame will show clearly on the finished product.

Although single blend drops 30, 32, 34 forming a single frame pattern 28 is shown, the system and method preferably deposits multiple blend drops side-by-side in a spaced relationship to form multiple frame patterns 28 on the web 12, creating a 3-D effect simulating traditional slate or wood roofs.

The first and second media applicators 20, 22 are capable of depositing granules in a pre-defined pattern, as described in greater detail below. The third media applicator 24 can be any device capable of applying granules, such as a conventional granule applicator device having a hopper and fluted roll applicator.

Figure 4:
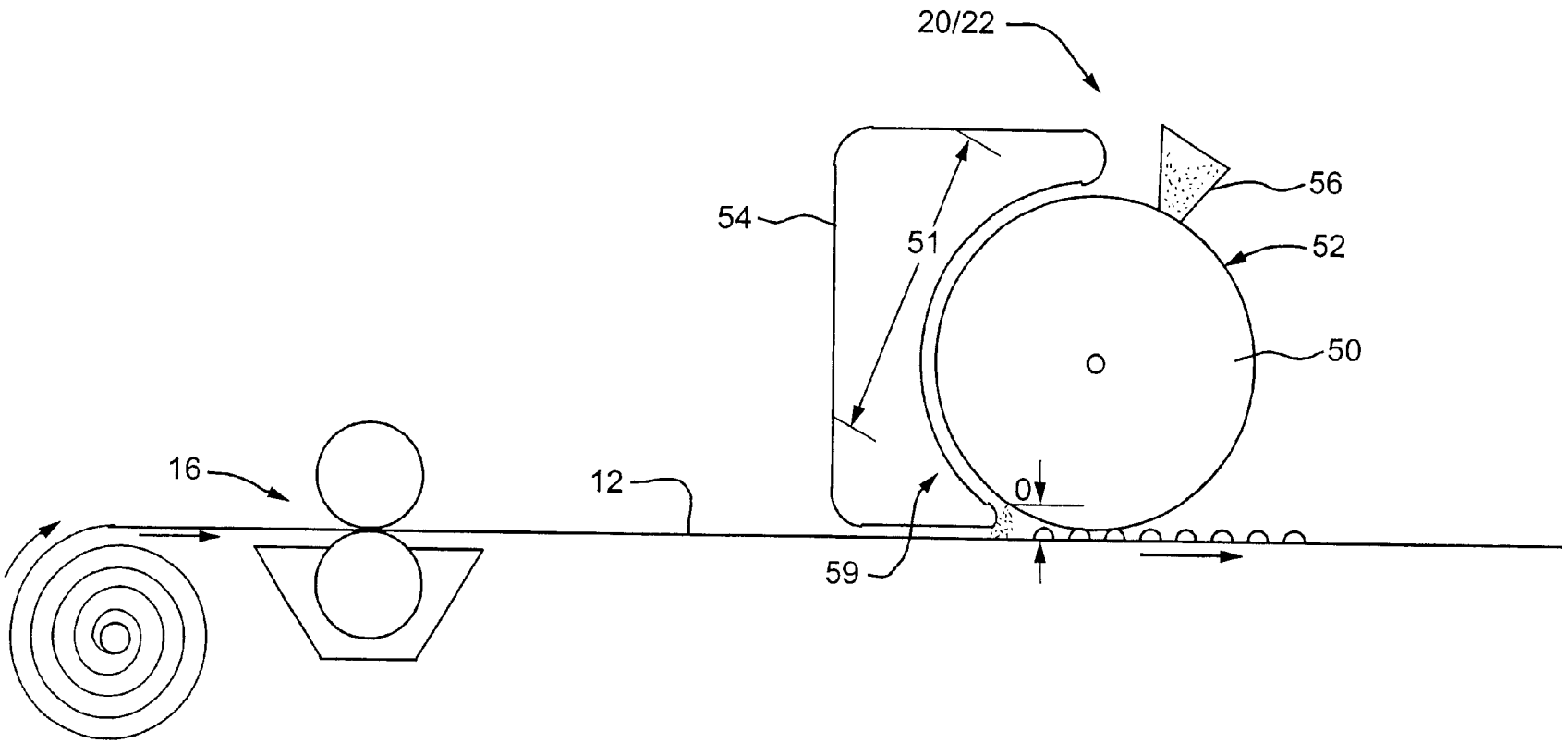
FIG. 4 is a side view of a media applicator for depositing granules in a predefined blend drop pattern, according to one embodiment of the present invention.

One example of the first and second media applicators 20, 22 is the media applicator disclosed in U.S. Pat. No. 5,814,369 or in U.S. Pat. No. 5,997,644, both assigned to the assignee of the present invention and incorporated herein by reference. This type of media applicator 20, 22, FIG. 4, includes a media applicator roll 50 having a media receiving region 52, such as an engraved or raised region, that receives the granules in the desired predefined blend drop pattern. In the exemplary embodiment, the first media applicator 20 has one or more engraved regions shaped as square frames corresponding to the frame pattern of the first blend drop 30 and the second media applicator 22 has one or more engraved regions shaped as solid squares corresponding to the solid square pattern of the second blend drop 32.

The media applicator 20, 22 further includes a media retaining member 54, such as a belt or chute, proximate at least a portion 51 of the media receiving region 52 of the applicator roll 50 that retains the granules in the predefined blend drop pattern on the media receiving region 52 until the granules are deposited on the web 12. Other techniques for retaining the granules in the predefined pattern are also contemplated. The media applicator 20, 22 further includes a media feeder 56, such as a hopper, for feeding the granules to the media receiving region 52 of the applicator roll 50.

The media retaining member 54 retains the granules within the media receiving region 52 along the portion 51 of the media receiving region 52 from a top region 58 to a bottom region 59 of the media applicator roll 12. Proximate the bottom region 59, the granules are released from the media receiving region 18 and dropped to the web 12 in the predefined blend drop pattern. The distance d that the granules drop or fall from the media receiving region 52 of the media applicator roll 50 to the web 12 is preferably minimized so that the granules are precisely deposited in the predefined blend drop pattern. Other types of media applicators capable of precisely depositing a pattern of granules can also be used.

Accordingly, the present invention provides a system and method capable of depositing blend drops in two or more colors to form a frame pattern having a 3-D effect simulating traditional slate or wood roofs.

Modifications and substitutions by one of ordinary skill in the art are considered to be within the scope of the present is invention which is not to be limited except by the claims which follow.

What is claimed is:

1. A method of depositing a plurality of color groups of granules to form a predefined pattern, said method comprising:

moving a sheet of material having an adhesive material on a surface thereof;

depositing a first group of granules on said moving adhesive coated surface of the sheet of material, said first group of granules having a first color and forming a first predefined blend drop pattern having a first and at least a second portion of granules deposited along and across said machine direction respectively, said first and said second portion forming said predefined blend drop pattern and defining an inner region;

depositing a second group of granules on said moving adhesive-coated surface of the sheet within said inner region of said first predefined pattern of said first group of granules, said second group of granules having a second color and forming a second predefined blend drop pattern, wherein said first predefined blend drop pattern and said second predefined blend drop pattern define an intermediate region therebetween; and depositing a third group of granules on said adhesive-coated surface of the moving sheet, wherein said third group of granules adheres to said moving sheet at least in said intermediate region between said first and second group of granules, wherein said first, second and third groups of granules are independently deposited in tandem to form said predefined pattern.

2. The method of claim 1 wherein said first predefined blend drop pattern is a frame pattern, and wherein said second predefined blend drop pattern is a solid pattern.

3. The method of claim 2 wherein said frame pattern and said solid pattern have generally rectangular shapes.

4. The method of claim 1 wherein said first and second blend drop patterns have generally rectangular shapes.

5. The method of claim 1 wherein said third group of granules has said first color such that said predefined pattern is a two color pattern.

6. The method of claim 1 wherein said third group of granules has a third color such that said predefined pattern is a three color pattern.

7. The method of claim 1 wherein the step of depositing said third group of granules includes depositing a curtain of granules over said moving web.

8. The method of claim 1 wherein said moving sheet of material is an asphalt adhesive-coated web.

9. The method of claim 8 wherein said third group of granules adheres to all remaining exposed asphalt on said asphalt-coated web.

10. The method of claim 1 wherein the steps are performed repeatedly to create a plurality of predefined patterns on said moving sheet of material.

11. A method of depositing a plurality of color groups of granules to form a predefined pattern, said method comprising:

moving a sheet of material having an adhesive material on a surface thereof;

depositing a first group of granules on said adhesive-coated surface of the moving sheet of material, said first group of granules having a first color and forming a first predefined blend drop pattern defining an inner region, wherein said first predefined blend drop pattern is a frame pattern;

depositing a second group of granules on said adhesive-coated surface of the moving sheet within said inner region of said first predefined pattern of said first group of granules, said second group of granules having a second color and forming a second predefined blend drop pattern, wherein said first predefined blend drop pattern and said second predefined blend drop pattern define an intermediate region therebetween, wherein said second predefined blend drop pattern is a solid pattern; and depositing a third group of granules on said adhesive-coated surface of the moving sheet, said third group of granules adheres to said moving sheet at least in said intermediate region between said first and second group of granules, wherein said first, second and third groups of granules are independently deposited in tandem to form said predefined pattern.

12. The method of claim 11 wherein said frame pattern and said solid pattern have generally rectangular shapes.

13. The method of claim 11 wherein said first and second blend drop patterns have generally rectangular shapes.

14. The method of claim 11 wherein said third group of granules has said first color such that said predefined pattern is a two color pattern.

15. The method of claim 11 wherein said third group of granules has a third color such that said predefined pattern is a three color pattern.

16. The method of claim 11 wherein the step of depositing said third group of granules includes depositing a curtain of granules over said moving web.

17. The method of claim 11 wherein said moving sheet of material is an asphalt adhesive-coated web.

18. The method of claim wherein said third group of granules adheres to all remaining exposed asphalt on said asphalt-coated web.

19. The method of claim 11 wherein the steps are performed repeatedly to create a plurality of predefined patterns on said moving sheet of material.

* * * * *